US005485183A

United States Patent [19]

Zandian et al.

[11] Patent Number: 5,485,183

[45] Date of Patent: Jan. 16, 1996

[54] INTERLACED DOT-ON-DOT PRINTING

[75] Inventors: Said Zandian, Agoura Hills; Leo J. Rheingold, Thousand Oaks, both of Calif.

[73] Assignee: DataProducts Corporation, Woodland Hills, Calif.

[21] Appl. No.: 83,560

[22] Filed: Jun. 30, 1993

[51] Int. Cl.[6] ..... B41J 2/01; B41J 2/145

[52] U.S. Cl. ..... 347/41

[58] Field of Search ..... 346/1.1, 140, 75; 347/41, 43, 40

[56] References Cited

U.S. PATENT DOCUMENTS

| | | | |
|---|---|---|---|
| 2,304,163 | 12/1942 | Goldsmith . | |
| 3,511,302 | 5/1970 | Barron | 164/24 |
| 4,009,332 | 2/1977 | Van Hook | 358/280 |
| 4,069,485 | 1/1978 | Martin | 346/75 |
| 4,097,873 | 6/1978 | Martin | 346/75 |
| 4,112,469 | 9/1978 | Paranjre et al. | 358/296 |
| 4,189,754 | 2/1980 | Gamblin | 358/296 |
| 4,198,642 | 4/1980 | Gamblin | 346/75 |
| 4,320,406 | 3/1992 | Heinzl | 346/140 R |
| 4,395,716 | 7/1983 | Crean et al. | 346/1.1 |
| 4,399,468 | 8/1983 | Mizuno | 358/280 |
| 4,427,985 | 1/1984 | Kikuchi et al. | 346/1.1 |
| 4,447,831 | 5/1984 | Adsett | 358/283 |
| 4,509,058 | 4/1985 | Fischbeck | 346/1.1 |
| 4,525,721 | 6/1985 | Crean | 346/1.1 |
| 4,533,928 | 8/1985 | Sugiura et al. | 346/140 R |
| 4,547,812 | 10/1985 | Waller et al. | 358/283 |
| 4,680,645 | 7/1987 | Dispoto et al. | 358/298 |
| 4,701,811 | 10/1987 | Moriguchi et al. | 358/298 |
| 4,714,964 | 12/1987 | Sasaki | 346/1.1 X |
| 4,741,930 | 8/1988 | Howard et al. | 427/265 |
| 4,809,016 | 2/1989 | Padalino | 346/75 |
| 4,930,018 | 5/1990 | Chan et al. | 358/298 |
| 4,963,882 | 10/1990 | Hickman | 347/41 |
| 4,965,593 | 10/1990 | Hickman | 346/140 R |
| 4,967,203 | 10/1990 | Doan et al. | 346/1.1 |

(List continued on next page.)

FOREIGN PATENT DOCUMENTS

| | | | |
|---|---|---|---|
| 0187352 | 12/1985 | European Pat. Off. . | |
| 0526233 | 7/1992 | European Pat. Off. . | |
| 526233 | 2/1993 | European Pat. Off. | 347/41 |
| 2094095 | 9/1982 | United Kingdom | 347/43 |

OTHER PUBLICATIONS

Jaffe and Mills (article), "Color Hard Copy for Computer Systems", *Proceedings of the SID*, vol. 24/3, 1983.

Knuth, Berry and Ollendick (article), "An Ink Jet Facsimile Recorder", *IEEE: Transactions on Industry Applications*, vol. IA–14, No. 2, Mar./Apr. 1978.

Koeblitz (article), "Technology of Asynchronous Ink Jet Printing", *Society of Photographic Scientists and Engineers*, 1974, pp. 179–181.

*Primary Examiner*—N. Le

*Attorney, Agent, or Firm*—Spensley Horn Jubas & Lubitz

[57] ABSTRACT

A method and apparatus for printing an image on a printing medium with phase change ink, the printing medium providing a printing area composed of a plurality of parallel pixel rows extending in a first direction, with a uniform spacing, p, between pixel rows in a second direction perpendicular to the first direction, with each row being made up of a plurality of elemental pixel areas. Printing is effected with a print head having at least one set of N nozzles for projecting drops of phase change ink onto the printing area, N being an integer and the nozzles having a uniform spacing, in a direction corresponding to the second direction when the print head faces a printing area, equal to s·p, s being an integer smaller than N and greater than unity, and relative movement is effected between the printing medium and the print head such that there are successive relative movements in the first direction while drops of phase change ink are projected onto respective pixel areas; and, in alternation with the successive movements in the first direction, there are stepwise relative movements in the second direction such that each stepwise movement in the second direction has an amplitude equal to an integral number multiple of p, which number is not equal to s, and the sum of the amplitudes of every two successive movements in the first direction is less than the product of N, s and p.

12 Claims, 4 Drawing Sheets

| Pixel row | Nozzle number | | | | |
|---|---|---|---|---|---|
| | First Pass | Second Pass | Third Pass | Fourth Pass | Fifth Pass |
| 1 | 12 | | 5 | | |
| 2 | | 9 | | 1 | |
| 3 | 14 | | 6 | | |
| 4 | | 10 | | 2 | |
| 5 | 15 | | 7 | | |
| 6 | | 11 | | 3 | |
| 7 | 16 | | 8 | | |
| 8 | | 12 | | 4 | |
| 9 | | | 9 | | 1 |
| 10 | | 13 | | 5 | |
| 11 | | | 10 | | 2 |
| 12 | | 14 | | 6 | |
| 13 | | | 11 | | 3 |
| 14 | | 15 | | 7 | |
| 15 | | | 12 | | 4 |
| 16 | | 16 | | 8 | |
| 17 | | | 13 | | 5 |
| 18 | | | | 9 | |
| 19 | | | 14 | | 6 |
| 20 | | | | 10 | |
| 21 | | | 15 | | 7 |
| 22 | | | | 11 | |
| 23 | | | 16 | | 8 |
| 24 | | | | 12 | |
| 25 | | | | | 9 |
| 26 | | | | 13 | |
| 27 | | | | | 10 |
| 28 | | | | 14 | |
| 29 | | | | | 11 |
| 30 | | | | 15 | |
| 31 | | | | | 12 |
| 32 | | | | 16 | |
| 33 | | | | | 13 |
| 34 | | | | | |
| 35 | | | | | 14 |
| 36 | | | | | |
| 37 | | | | | 15 |
| 38 | | | | | |
| 39 | | | | | 16 |

U.S. PATENT DOCUMENTS 5,059,984 10/1991 Moore et al. ..... 346/1.1
5,070,345 12/1991 Lohut et al. ..... 346/1.1
5,079,564 1/1992 Sasaki et al. ..... 346/76 PH
5,079,571 1/1992 Eriksen ..... 346/140 R
5,111,302 5/1992 Chan et al. ..... 346/1.1 X
5,121,142 6/1992 Iwazawa et al. ..... 346/140 R
5,300,950 4/1994 Lopez et al. ..... 346/1.1

| Pixel row | Nozzle number | | | | |
|---|---|---|---|---|---|
| | First Pass | Second Pass | Third Pass | Fourth Pass | Fifth Pass |
| 1 | 13 | | 5 | | |
| 2 | | 9 | | 1 | |
| 3 | 14 | | 6 | | |
| 4 | | 10 | | 2 | |
| 5 | 15 | | 7 | | |
| 6 | | 11 | | 3 | |
| 7 | 16 | | 8 | | |
| 8 | | 12 | | 4 | |
| 9 | | | 9 | | 1 |
| 10 | | 13 | | 5 | |
| 11 | | | 10 | | 2 |
| 12 | | 14 | | 6 | |
| 13 | | | 11 | | 3 |
| 14 | | 15 | | 7 | |
| 15 | | | 12 | | 4 |
| 16 | | 16 | | 8 | |
| 17 | | | 13 | | 5 |
| 18 | | | | 9 | |
| 19 | | | 14 | | 6 |
| 20 | | | | 10 | |
| 21 | | | 15 | | 7 |
| 22 | | | | 11 | |
| 23 | | | 16 | | 8 |
| 24 | | | | 12 | |
| 25 | | | | | 9 |
| 26 | | | | 13 | |
| 27 | | | | | 10 |
| 28 | | | | 14 | |
| 29 | | | | | 11 |
| 30 | | | | 15 | |
| 31 | | | | | 12 |
| 32 | | | | 16 | |
| 33 | | | | | 13 |
| 34 | | | | | |
| 35 | | | | | 14 |
| 36 | | | | | |
| 37 | | | | | 15 |
| 38 | | | | | |
| 39 | | | | | 16 |

FIG. 5

INTERLACED DOT-ON-DOT PRINTING

BACKGROUND OF THE INVENTION

The present invention relates to the production of printed images composed of a pattern of dots produced by the application of individual ink drops to a printing medium.

In the printing art, there exist printers which operate according to a variety of techniques, many of which fall in the category of printers that form images upon a printing medium by depositing rows of ink dots in a desired pattern. Printers of this type generally include a print head provided with an array of nozzles for ejecting ink droplets toward the printing medium. During relative movement between the print head and the printing medium, referred to herein as scanning, each nozzle traverses a line, or pixel row, on the printing medium and deposits ink drops at desired locations, or pixel areas, along that row. These relative movements are typically referred to as scanning. Bands of ink dots are formed on the print medium by effecting a relative displacement between the print head and the print medium, referred to herein as indexing, in a direction generally perpendicular to the direction of relative movement during each printing pass.

The inks employed in such printers include aqueous inks which are liquid at room temperature and phase change inks which are solid at room temperature and which change to a liquid state upon being heated. Aqueous inks contain a pigment dissolved in a solvent, the solvent evaporating after delivery of each ink drop to the printing medium, leaving behind pigment which has penetrated into the printing medium. Phase change inks are heated to remain in the liquid state until striking the printing medium, whereupon each drop of ink solidifies by cooling.

Among the techniques which have been developed for performing printing are interlace techniques in which the spacing between nozzles is such that alternate pixel rows are printed during one printing pass and intervening pixel rows are printed during a subsequent printing pass. Interlacing patterns can be provided to minimize printing defects, such as the horizontal banding effect which results from cross-talk between nozzles, as well as the seaming effect which is caused by variations in the amplitude of the relative movements between printing passes. In addition, particularly in the case of phase change inks, interlacing allows each pixel row to be printed at a time when both adjoining pixel rows have not yet been printed or have both been printed, thereby creating a condition of thermal symmetry, which improves the appearance of the resulting printed image. In addition, for a given image resolution, expressed in terms of dots per inch (dpi), interlaced printing of the type described above makes possible an adequate spacing between nozzles which simplifies print head manufacture.

Printers of the type described above have also been developed for producing multicolor images by applying ink dots in a variety of colors, such printers generally being equipped to perform printing with black ink and with a set of primary color inks such as cyan, magenta and yellow inks. It has been found that by applying dots of inks of different colors atop one another, or immediately adjacent one another, a wide range of colors can be reproduced including, in addition to the primary colors mentioned above, red, green and blue, which are secondary colors formed from various combinations of two of the primary colors mentioned above.

It has further been proposed to enlarge the color palette available for printed images by dividing the printing medium surface into an array of super pixels each constituting a generally square area of four or more elemental pixels. Each super pixel represents one picture element and can be printed with a selected combination of ink dots. As a result, a wide variety of colors and gray scale levels can be produced at each super pixel. Arrangements of this type are disclosed, for example, in U.S. Pat. Nos. 4,967,203, Doan et al, and 5,111,302, Chan et al.

In the apparatus disclosed in the patent to Doan et al, alternate super pixels in each super pixel row and column are printed during one print head pass, and intervening super pixels are printed during the next succeeding print head pass.

While the Chan et al patent mentions the applicability of the disclosed technique to ink jet printers, it only provides a detailed description of a printing operation performed with a laser printer, and provides no information relating to the pattern or sequence in which super pixels are printed. The Chan et al patent does describe the possibility of varying the diameter of the ink dot formed at each elemental pixel in order to provide further gray scale levels in the printed image.

To date, no technique for forming a printed image of super pixels while retaining the advantages of true interlace scanning have been proposed.

In addition, interlacing schemes which have been previously proposed are effective to reduce printing defects. Nevertheless, they can give rise to printing defects when even small errors exist in the print medium indexing movements. Such defects include reflectance variations in the printed image and a high frequency seaming effect.

SUMMARY OF THE INVENTION

It is an object of the present invention to increase the number of color and gray scale gradations which can be produced by a color printer.

The above and other objects are achieved, according to the invention, by the provision of a method and apparatus for producing a printed image on a printing medium with phase change ink, the printing medium providing a printing area having a width dimension extending in a first direction and a height dimension extending in a second direction perpendicular to the first direction, the printing area being composed of a plurality of parallel pixel rows extending in the first direction with a uniform spacing, p, between pixel rows in the second direction, with each row being made up of a plurality of elemental pixel areas, the apparatus including a print head having at least one set of N nozzles for projecting drops of phase change ink onto the printing area, N being an integer and the nozzles having a uniform spacing, in a direction corresponding to the second direction when the print head faces a printing area, equal to s·p, s being an integer smaller than N and greater than unity, and control means for effecting relative movement between the printing medium and the print head. The control means are operative to cause the relative movement to include: successive passes of the print head in the first direction while drops of phase change ink are projected onto respective pixel areas; and in alternation with the successive passes in the first direction, stepwise movements of the print head in the second direction such that each stepwise movement in the second direction has an amplitude equal to an integral number multiple of the spacing between pixel rows, which number is not equal to s, and the sum of the amplitudes of every two successive movements in the first direction is less than the product of N, s and p.

BRIEF DESCRIPTION OF THE DRAWING

FIG. 5 is a table illustrating successive displacements of a printing medium relative to a print head according to one preferred embodiment of the invention.

DESCRIPTION OF THE PREFERRED EMBODIMENTS

Figure 1:
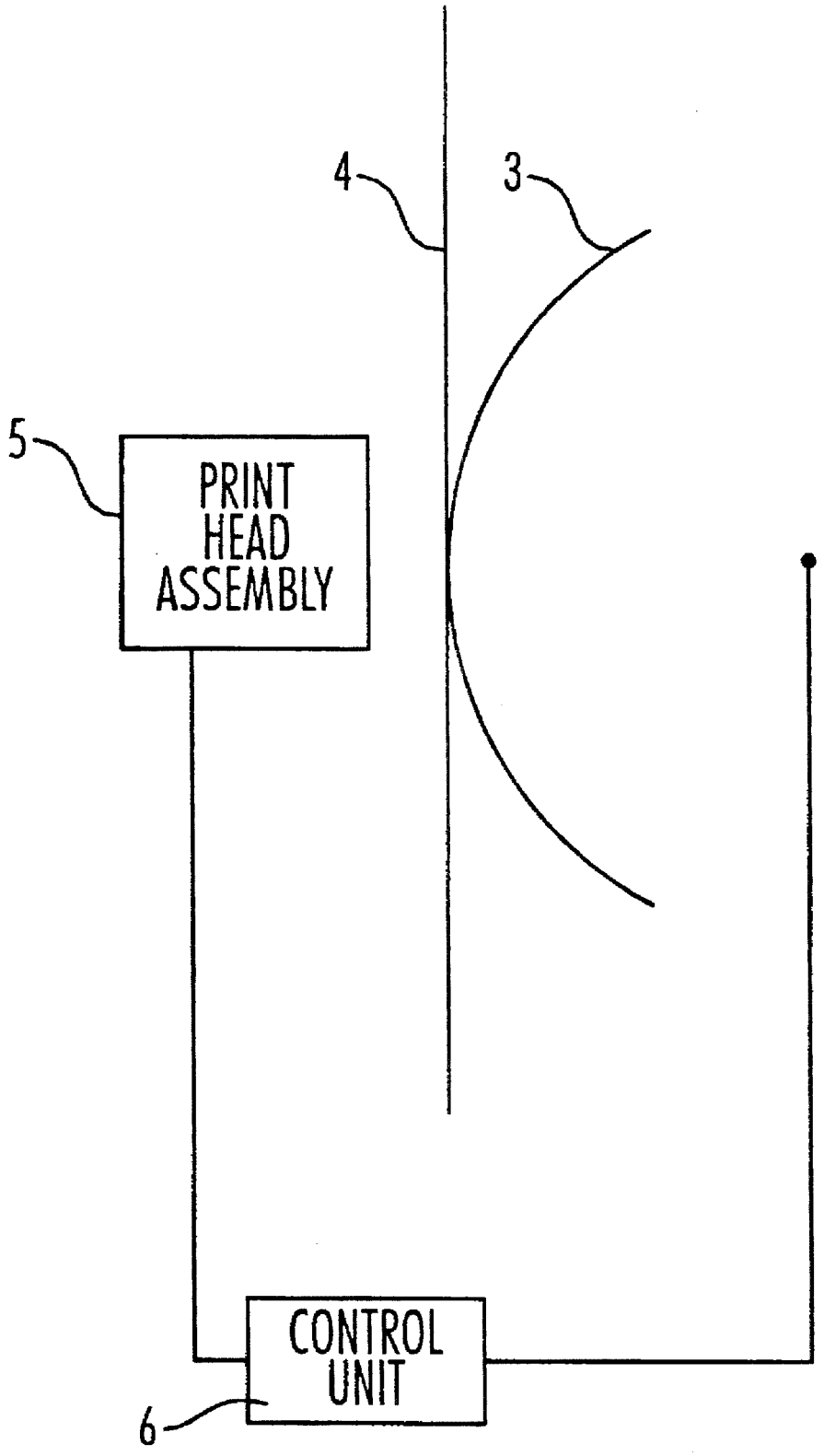
FIG. 1 is a simplified pictorial view of a printer which may be used in the practice of the present invention.

FIG. 1 is a simplified diagram illustrating a printer which may be configured and/or programmed to implement this invention. The printer includes, as basic components, a platen 3 for supporting and displacing a printing medium 4, most commonly a paper sheet, in an indexing direction, a print head assembly 5 and a control unit 6. Assembly 5 includes a print head provided with an array of nozzles and a carriage for displacing the print head in a scanning direction. Control unit 6 is connected to control the scanning movements of the print head, activation of the print head nozzles and indexing movements of platen 3. All of the components shown in FIG. 1 may be constructed and operated according to well known principles, the difference from the prior art being in the programming of control unit 6 to produce the desired indexing movements and nozzle activation.

While the operation of the printer shown in FIG. 1 involves scanning movements by the print head and indexing movements by platen 3, there are printers in which the platen, or printing medium, performs the scanning movements and the print head performs the indexing movements. The present invention can be practiced with either type of printer.

The print head is preferably provided with several arrays of ink jet nozzles, one for each ink color. However, the invention can also provide improvements in a single color printer, in which only one array of nozzles would be provided.

Figure 2:
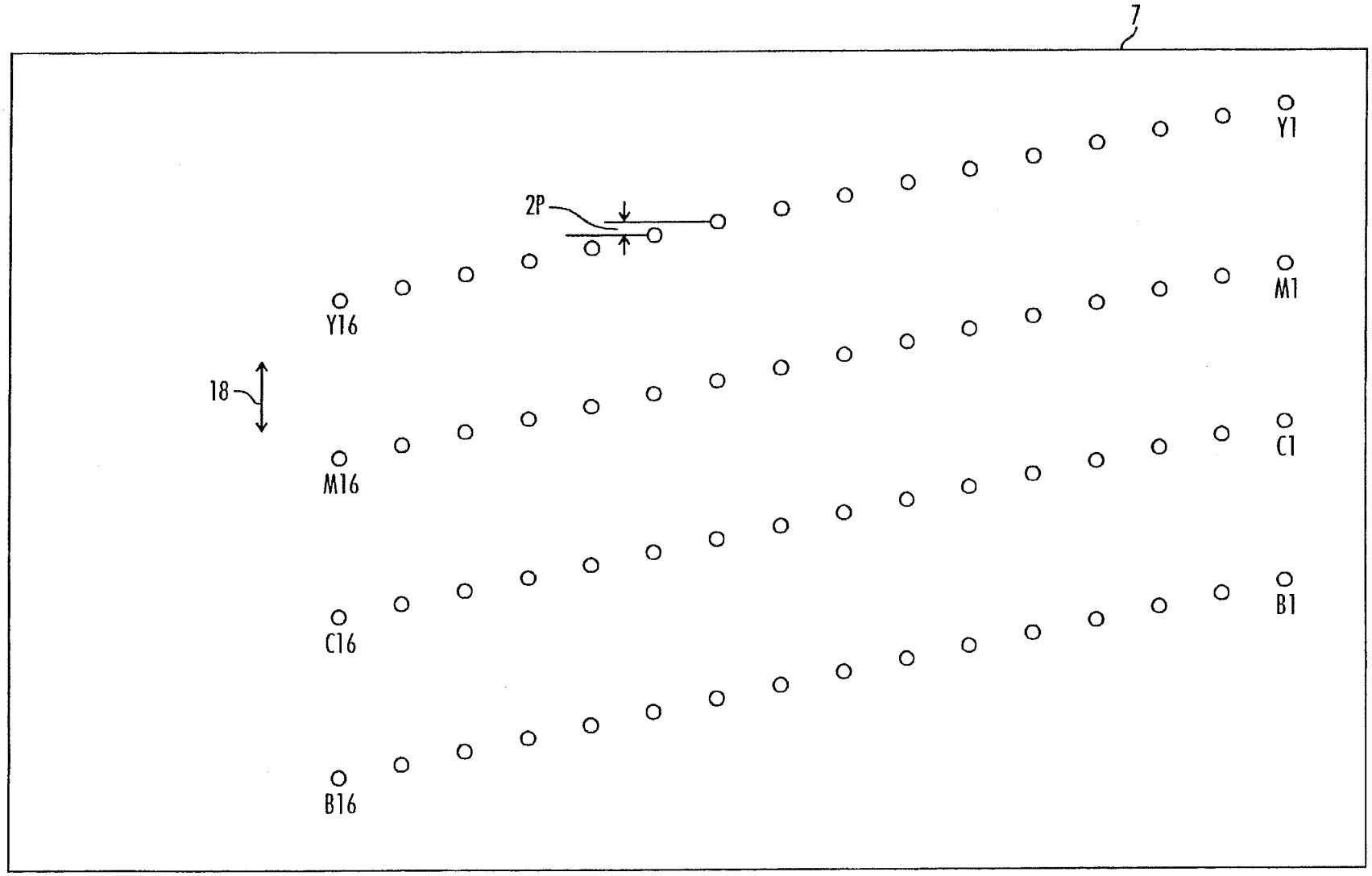
FIG. 2 is a pictorial view of one print head nozzle configuration which can be employed in the practice of the invention.

A print head provided with one suitable nozzle array pattern for a full color printer is shown in FIG. 2. This print head 7 has four rows of nozzles, each consisting of sixteen nozzles. These include black ink nozzles B1 to B16, cyan ink nozzles C1 to C16, magenta ink nozzles M1 to M16 and yellow ink nozzles Y1 to Y16. In each nozzle row, the nozzles are equispaced, in a direction 8 which represents the direction of relative indexing movement between print head 7 and a printing medium, by a distance 2p, where p is the spacing between adjacent pixel rows.

Other nozzle patterns can be employed, so long as the spacing between the nozzles for each color is equal to an integral multiple of p.

The purpose of the present invention is to provide a larger range, as well as a larger number of gradations, of colors and gray scale levels in a printed image for a given image resolution.

This result is achieved, according to the present invention, by forming the printed image of super pixels, each super pixel being constituted by a square array of four or more elemental pixels, and by performing printing with interlace scanning in a pattern that allows two ink drops to be applied atop one another onto selected elemental pixel areas. In this manner, as will be described below, it becomes possible to increase image gradations.

Figure 3:
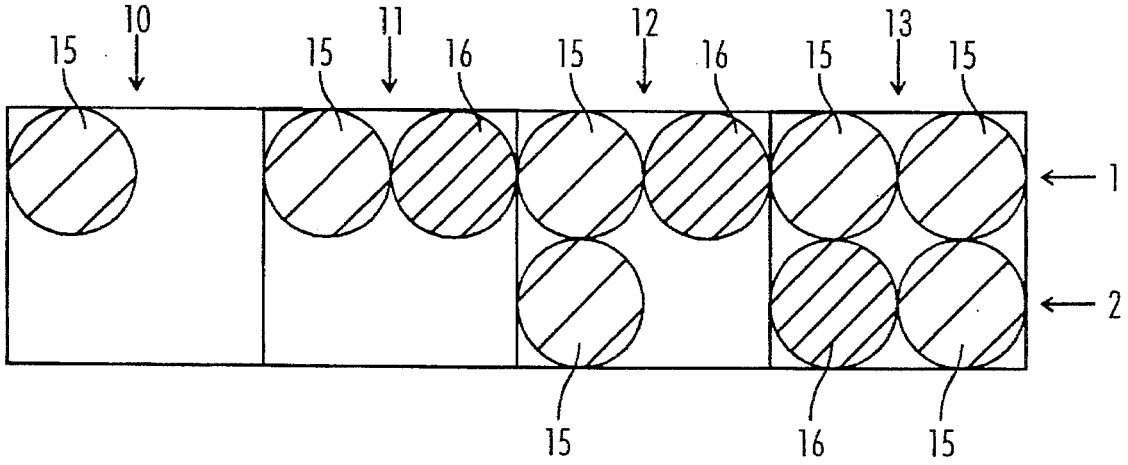
FIGS. 3 and 4 are pictorial views showing various ink dot combinations which can be generated in accordance with the invention.

A first technique according to the invention is illustrated in FIG. 3, which shows a small segment of two pixel rows 1 and 2 forming four super pixels 10, 11, 12 and 13, each super pixel being made up of four elemental pixel areas, with two of these pixel areas being in row 1 and two being in row 2.

As is already known in the art, in a given super pixel, each pixel area may be free of ink, or may be provided with a dot of ink having any selected color. Within each super pixel, one or more dots of ink of the same color or of different colors can be deposited.

In the practice of the present invention, an elemental pixel area can be printed with one or more dots of ink of a single color or different colors. When the ink employed is a phase change ink, the formation of several ink dots upon one another, known as dot-on-dot printing, permits a larger range of variations to be achieved in a printed image. Dot-on-dot printing offers particular benefits when phase change ink is being used because these inks solidify with sufficient rapidity that a second dot applied atop a first dot in an elemental pixel area will remain confined to the region occupied by the first dot, i.e. will not spread beyond the edge of the first dot. Therefore, the application of successive dots of phase change ink will not, of itself, reduce image resolution. When two dots of ink of the same color are applied, the result is an increase in the intensity of the color. When inks having two different colors are applied atop one another, a corresponding secondary color is created at that elemental pixel area.

In order to illustrate several combinations which may exist in a super pixel, the ink dots shown in FIG. 3 include dots 15 which are formed from a single drop of ink, these dots being represented by wide hatching, and dots 16 composed of two successively applied drops of ink. As noted above, each dot 16 may be formed by two drops of ink of the same color or of inks of respectively different colors.

As will be explained in greater detail below, each ink dot 16 can also be formed of more than two drops of ink deposited upon one another.

Figure 4:
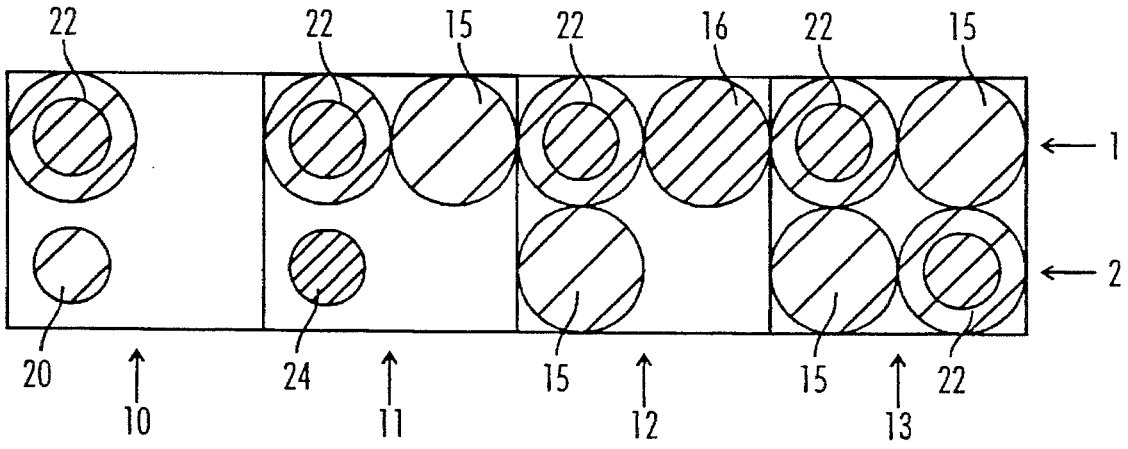

According to a second technique employed in the practice of the invention, the quantity of ink in each ink drop can be altered in order to correspondingly alter the size of the resulting ink dot and various combinations of different sized ink dots can then be employed to produce different apparent intensity levels. For example, as shown in FIG. 4, dot 15 is a full sized dot formed from a single ink drop, while dot 20 is a smaller dot formed by an ink drop having a reduced volume. Variation in the size of each component dot of a printed image is described in U.S. Pat. No. 3,511,302, cited above, in the context of a laser printer. An elemental pixel area containing a dot 20 will appear to have a lower apparent color intensity than an elemental pixel area containing a full size dot 15.

In further accordance with the invention, at selected elemental pixel areas, a full size dot 15 and a smaller dot 20 are printed upon one another, to form a dot 22 having a higher intensity than a dot 15, but a lower intensity than a dot 16. Here again, the two dots applied to an elemental pixel area can be of the same color or of different colors. An elemental pixel area may also be provided with a smaller size dot 24 formed from two successively applied ink drops which each contain the smaller volume of ink.

Thus, by the addition of dot-on-dot printing, with phase change ink, to the super pixel techniques previously proposed, an increased range of intensities and colors, with finer gradations therein, can be achieved.

The above-described techniques according to the invention permit, for example, two intensity levels for each available ink color to be produced at an elemental pixel area. Examples of the variety of colors and color intensities which can be produced at each elemental pixel area by the techniques illustrated in FIGS. 3 and 4 are set forth below with respect to ink drops which all contain the same volume of ink, whether to form a dot which is coextensive with the elemental pixel area, such as dot 15, or a dot which covers a limited portion of the elemental pixel area, such as dot 20.

| | | |
|---|---|---|
| Cyan: | C1 | Single dot |
| | C2 | Double dot |
| Magenta: | M1 | Single dot |
| | M2 | Double dot |
| Yellow: | Y1 | Single dot |
| | Y2 | Double dot |
| Black: | B1 | Single dot |
| | B3 | Double dot |
| Red: | R1 | M1 overprinted by Y1 |
| | R2 | M2 overprinted by Y1 |
| | R3 | M1 overprinted by Y2 |
| | R4 | M2 overprinted by Y2 |
| Green: | G1 | C1 overprinted by Y1 |
| | G2 | C2 overprinted by Y1 |
| | G3 | C1 overprinted by Y2 |
| | G4 | C2 overprinted by Y2 |
| Blue: | B1 | C2 overprinted by M1 |
| | B2 | C2 overprinted by M1 |
| | B3 | C1 overprinted by M2 |
| | B4 | C2 overprinted by M2 |

As is indicated in the above table, various hues and intensities of the secondary colors, red, green, blue can be formed by applying, at an elemental pixel area, more than two ink drops, although only two drops of a given color will be applied at any elemental pixel area.

In addition to the range of colors and intensities which can be produced at an elemental pixel area, it will be appreciated, based on principles already known in the art, that an even wider range of intensities and colors can be produced in each super pixel by an appropriate selection of the ink drop or drops delivered to each elemental pixel area of the super pixel.

By way of example, considering only the application of ink of one color to the elemental pixel areas of a super pixel, 14 different shades, or intensity levels, of the given color can be produced in a super pixel by the possible combinations of single and double dots at each elemental pixel area, when all of the dots are full size.

In accordance with the invention, the techniques described above are employed for image printing with interlacing of adjacent elemental pixel rows. This means that, with respect to the super pixels shown in FIGS. 3 and 4, all pixels in row 1, and a certain number of succeeding odd numbered rows, will be printed during two passes of the print head, while pixel row 2, and at least several even numbered rows thereafter, will be printed during two other printing passes.

One example of an indexing scheme according to the present invention is depicted in FIG. 5. This indexing scheme is advantageously employed when it is desired to have the capability of printing two dots atop one another in any given elemental pixel area. The print head nozzles are spaced apart by 2p, a distance equal to two times the spacing between adjacent pixel rows, in the indexing direction and indexing is performed to effect printing in odd pixel rows during one scanning pass and in even pixel rows during the next following scanning pass.

Thus, as shown in FIG. 5 for printing in one color, during a first scanning pass, the lower four nozzles 13– 16 scan pixel rows 1, 3, 5 and 7. Then, there is effected an indexing movement having an amplitude equal to nine times the spacing between pixel rows and even number pixel rows are scanned by nozzles 9–16. The following indexing movement has an amplitude of seven times the spacing between two adjacent pixel rows. Then, during the third pass, odd numbered pixel rows, starting with pixel row 1, are scanned by nozzles 5–16. It will be noted that during the third pass, pixel rows 1, 3, 5 and 7 are scanned for the second time to permit application of a second dot to any elemental pixel area in those rows.

It will further be noted that prior to the fourth and fifth passes, the indexing movements have amplitudes of nine times and seven times, respectively, the spacing between two adjacent pixel rows. Thus, with this indexing scheme, the amplitudes of the indexing movements alternate between two values while the sum of the amplitudes of two successive indexing movements is equal to the product of the number of nozzles, in this case 16, multiplied by p, the spacing between two adjacent pixel rows.

When full color printing is effected with the nozzle arrangement illustrated in FIG. 5, each portion of a printing area will be printed successively with black ink, cyan ink, magenta ink and yellow ink. While, with the specific arrangement described above, each pixel area can receive only two drops of ink of a given color, inks of other colors can also be deposited on the same pixel area, as indicated earlier herein, to produce any desired color within a pixel area. The ink colors deposited in different areas of a super pixel will then determine the apparent color hue and intensity of the printed image at that super pixel.

Indexing movements are effected according to the invention in a manner to facilitate dot-on-dot printing while retaining the advantages of true interlace scanning, including reduction or elimination of banding effects. In addition, during each print head pass only alternate pixel rows are printed so that thermal effects are minimized. At the same time, all nozzles which are in registry with the printing area are used for printing.

All of these results are achieved, according to the invention, by providing an ink jet nozzle arrangement in which the spacing between nozzles, in the indexing direction, is an integral number multiple, $s \geqq 2$, of the spacing, p, between pixel rows, each indexing movement has an amplitude equal to $n \cdot p$, where n is an integral number $\neq s$, and the sum of the amplitudes of every two indexing movements is equal to $m \cdot s \cdot p$, where m is an integer which is less than the number of nozzles in a nozzle set.

If printing is to involve applying a maximum of two drops of ink from one nozzle set to any one pixel area, and s=2, indexing is performed so that two successive indexing movements cover a distance equal to the product of p multiplied by the total number of nozzles in a nozzle set, each individual indexing movement has an amplitude which is an odd number multiple of p, and successive indexing movements differ from one another in amplitude by an even numbered multiple of p. Since the sum of two successive indexing movements is an even number multiple of p, each pixel row will be scanned by at least two different nozzles during different scanning passes.

The invention may also be practiced with nozzle arrays having an odd number of nozzles, in which case the sequence of indexing movements is selected to achieve appropriate interlacing. In addition, as is known in the art, printing can be performed bidirectionally, i.e. during both left-to-right and right-to-left print head scanning movements parallel to the pixel rows.

According to another embodiment of the present invention, during each scanning movement, each nozzle is enabled to print only every other pixel area of the row being scanned by that nozzle. Then, during the next scanning movement when that row is being scanned, the corresponding nozzle is enabled to print the intervening pixel areas. This technique further reduces visible defects due to imperfect nozzle orientations and/or indexing movement errors. Since alternate pixel areas of each pixel row are printed by two nozzles during different scanning passes, the two sets of dots in a row may be offset from one another in the indexing direction in a manner to hide defects caused by the above-mentioned imperfections.

To explain this embodiment of the invention, assume that each pixel row consists of a succession of adjacent pixel areas numbered, from left to right, 1, 2, 3, 4, 5, . . . Now, referring again to FIG. 5, during the first pass, nozzles 13–16 will each be activated for printing odd-numbered pixel areas 1, 3, 5, . . . of respective odd-numbered rows 1, 3, 5 and 7. During the second pass, nozzles 9–16 will each be activated to print even-numbered pixel areas 2, 4, 6 . . . of respective even-numbered rows 2, 4, 6, 8, 10, 12, 14 and 16. During the third pass, nozzles 5–16 will each be activated to print even-numbered pixel areas 2, 4, 6 . . . of respective odd-numbered rows 1, 3, 5 . . . 23. During the fourth pass, nozzles 1–16 will each be activated to print odd-numbered pixel areas 1, 3, 5 . . . of even-numbered pixel rows 2, 4, 6 . . . 32.

In this embodiment, only a maximum of one dot is printed at each pixel area. However, this embodiment achieves horizontal thermal symmetry similar to the vertical thermal symmetry described earlier herein. Preferably, this embodiment employs bidirectional scanning, i.e. the odd-numbered scanning passes are left to right and the even-numbered scanning passes are right to left.

As in the first-described embodiment, the pattern described above will be employed for printing with each row of nozzles B, C, M and Y.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

WHAT IS CLAIMED:

1. In apparatus for producing a printed image on a printing medium with phase change ink, the printing medium providing a printing area having a width dimension extending in a first direction and a height dimension extending in a second direction perpendicular to the first direction, the printing area being composed of a plurality of parallel pixel rows extending in the first direction with a uniform spacing, p, between pixel rows in the second direction, with each row being made up of a plurality of elemental pixel areas, the improvement wherein said apparatus comprises:

a print head having at least one set of N nozzles for projecting drops of phase change ink onto the printing area, N being an integer greater than 2 and said nozzles having a uniform spacing, in a direction corresponding to the second direction when said print head faces a printing area, equal to s·p, s being an integer smaller than N and greater than unity; and control means for effecting relative movement between the printing medium and said print head such that the relative movement includes:

successive passes of said print head in the first direction while said drops of phase change ink are projected onto respective pixel areas; and in alternation with the successive passes in the first direction, stepwise movements of said print head in the second direction such that each stepwise movement in the second direction has an amplitude equal to an integral number multiple of p, which said integral number is not equal to s, and the amplitudes of every two successive movements in the second direction have a sum which is less than N·S·P; and wherein said control means effect said relative movement for enabling printing to be performed on all elemental pixel areas of each said pixel row by ink from respectively different nozzles during two different passes of said print head in the first direction.

2. Apparatus as defined in claim 1 wherein said control means are operative to cause each drop of ink projected onto a pixel row to have a respectively different volume during each of the two different passes associated with that pixel row.

3. Apparatus as defined in claim 1 wherein said control means are operative to cause a drop of ink having a volume with a first value to be projected onto one elemental pixel area during a first one of the two different passes associated with the pixel row containing the one elemental pixel area and to cause a drop of ink having a volume with a second value different from the first value to be projected onto the one elemental pixel area during a second one of the two different passes associated with the pixel row containing the one pixel area.

4. Apparatus as defined in claim 1 wherein said control means control said print head for projecting drops of phase change ink onto one pixel row of the printing area in a first pattern during a first one of the two different passes associated with that pixel row and in a second pattern, different from the first pattern, during a second one of the two different passes associated with that pixel row.

5. In a method for producing a printed image on a printing medium with phase change ink, the printing medium providing a printing area having a width dimension extending in a first direction and a height dimension extending in a second direction perpendicular to the first direction, the printing area being composed of a plurality of parallel pixel rows extending in the first direction with a uniform spacing, p, between pixel rows in the second direction, with each row being made up of a plurality of elemental pixel areas, printing being performed by a print head having at least one set of N nozzles for projecting drops of phase change ink onto the printing area, N being an integer greater than 2, and the nozzles having a uniform spacing, in a direction corresponding to the second direction when the print head faces a printing area, equal to s·p, s being an integer smaller than N and greater than unity; the improvement wherein said method comprises:

effecting relative movement between the printing medium and the print head such that the relative movement includes:

successive passes of the print head in the first direction while drops of phase change ink are projected onto respective pixel areas; and in alternation with the successive passes in the first direction, stepwise movements of the print head in the second direction such that each stepwise movement in the second direction has an amplitude equal to an integral number multiple p, which said integral number is not equal to s, and the amplitudes of every two successive movements in the second direction have a sum which is less than N·s·p; and wherein the relative movement is effected for enabling printing to be performed on all elemental pixel areas of each said pixel row by ink from respectively different nozzles during two different passes of the print head in the first direction.

6. A method as defined in claim 5 further comprising controlling the print head to cause each drop of ink projected onto a pixel row to have a respectively different volume during each of the two different passes associated with that pixel row.

7. A method as defined in claim 5 wherein the printing medium has a surface is divided into an array of super pixels each constituting a generally square area composed of at least four elemental pixels, each super pixel representing one picture element to be printed with a selected combination of ink dots.

8. A method as defined in claim 5 wherein during successive passes of the print head, drops of two different color inks are deposited upon one another at selected elemental pixel areas.

9. A method as defined in claim 5 wherein during successive passes of the print head, drops of ink of one color are deposited upon one another at selected elemental pixel areas.

10. A method as defined in claim 9 wherein the drops of ink deposited upon one another at a selected pixel area have respectively different volumes.

11. A method as defined in claim 5 further comprising controlling operation of the print head to cause a drop of ink having a volume with a first value to be projected onto one elemental pixel area during a first one of the two different passes associated with the pixel row containing the one elemental pixel area and to cause a drop of ink having a volume with a second value different from the first value to be projected onto the one elemental pixel area during a second one of the two different passes associated with the pixel row containing the one pixel area.

12. A method as defined in claim 5 further comprising controlling the operation of the print head for projecting drops of phase change ink onto one pixel row of the printing area in a first pattern during a first one of the two different passes associated with that pixel row and in a second pattern, different from the first pattern, during a second one of the two different passes associated with that pixel row.

* * * * *